US007130571B2

(12) United States Patent
Berg et al.

(10) Patent No.: US 7,130,571 B2
(45) Date of Patent: Oct. 31, 2006

(54) VARIABLE TORQUE DEVICE FOR MAINTAINING CONSTANT WEB TENSION

(75) Inventors: Richard H. Berg, Greenville, SC (US); James D. Shifley, Spencerport, NY (US); Douglas J. Pfaff, Rochester, NY (US); James W. Gunn, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 146 days.

(21) Appl. No.: 11/011,282

(22) Filed: Dec. 14, 2004

(65) Prior Publication Data

US 2005/0147433 A1 Jul. 7, 2005

Related U.S. Application Data

(60) Provisional application No. 60/531,351, filed on Dec. 19, 2003.

(51) Int. Cl.
*G03G 15/20* (2006.01)

(52) U.S. Cl. ..... 399/325; 399/324; 242/410

(58) Field of Classification Search ..... 399/324, 399/325, 326, 384–387; 242/410
See application file for complete search history.

(56) References Cited

U.S. PATENT DOCUMENTS 3,599,896 A * 8/1971 Schwartz ..... 242/330
5,749,038 A * 5/1998 Fromm et al. ..... 399/327
6,006,063 A * 12/1999 Shimizu et al. ..... 399/325

* cited by examiner

*Primary Examiner*—David M. Gray
*Assistant Examiner*—Erika Villaluna
(74) *Attorney, Agent, or Firm*—Lawrence P. Kessler

(57) ABSTRACT

A variable torque device for maintaining constant tension in a web of material as the web is unwound from a supply roll. The variable torque device includes a lead screw attached to the shaft of the supply roll via an appropriate gear ratio. A coil spring is located between a hub on the lead screw and a set of rings and friction pads. As the lead screw rotates, the hub translates, thus changing the displacement of the coil spring, which in turn changes the loading of the rings and friction pads. With a full supply roll the coil spring is compressed so as to create an amount of torque to create the desired web tension. As the supply roll unwinds, the rotation of the lead screw translates the hub to expand the coil spring, reducing the torque and maintaining the web tension constant.

24 Claims, 5 Drawing Sheets

VARIABLE TORQUE DEVICE FOR MAINTAINING CONSTANT WEB TENSION

CROSS REFERENCE TO RELATED APPLICATION

Reference is made to and priority claimed from U.S. Provisional Application Ser. No. 60/531,351, filed Dec. 19, 2003, entitled VARIABLE TORQUE DEVICE FOR MAINTAINING CONSTANT WEB TENSION.

FIELD OF THE INVENTION

This invention relates in general to a variable torque apparatus, and more particularly to a variable torque device for maintaining constant tension in a web of material, as it is unwound from a roll.

BACKGROUND OF THE INVENTION

Many applications and/or processes involve the unwinding of material, in the form of a web, from a roll as the material is subsequently used in the application or process. Subsequent to unwinding, the material may be used in the process and then wound onto a take-up roll, or it may be cut or slit into parts to be consumed in the process. Materials used in these processes may have widely varying physical properties, such as flexibility, breaking strength, elasticity, etc. Depending upon the physical properties of the material and/or the nature of the subsequent process, it may be important to maintain the tension in the material constant or at least within a narrow range, as the material is being unwound from the roll. As anyone skilled in the art will recognize, if the torque exerted on the roll is constant, the tension in the material will increase as it is unwound and the diameter of the roll decreases.

An example of such a process is a web type release fluid applicator for fusers in electrostatographic reproduction apparatus such as copier/duplicators, printers, or the like. In electrostatographic reproduction apparatus a latent image charge pattern is formed on a uniformly charged charge-retentive or photoconductive member having dielectric characteristics. Pigmented marking particles are attracted to the latent image charge pattern to develop such image on the photoconductive member. A receiver member, such as a sheet of paper, transparency, or other medium, is then brought into contact with the photoconductive member, and an electric field applied to transfer the marking particle developed image to the receiver member from the photoconductive member. After transfer, the receiver member bearing the transferred image is transported away from the photoconductive member, and the image is fixed (fused) to the receiver member by heat and pressure to form a permanent reproduction thereon.

One type of fuser assembly for typical electrostatographic reproduction apparatus includes at least one heated roller, having an aluminum core and an elastomeric cover layer, and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

With roller fuser assemblies, it is common practice to use release fluids, such as silicone oil for example, applied to the fuser roller surface to improve the release of image-carrying receiver members from the fuser roller. The most common types of release fluid applicators or oilers are a rotating wick roller, a donor/metering roller, an oil impregnated pad or roller, an oil impregnated web, or variations or combinations of the above. In a release oil applicator utilizing an oil-impregnated web, the web is, for example, formed as a porous membrane capable of retaining release oil. The oil-impregnated web extends from a supply roll to a take-up roll. The portion of the oil impregnated web between the supply roll and the take-up roll is directed about intermediate rollers, at least one of which is a back-up roller urging the oil-impregnated web into contact with the heated fuser roller. Another of the intermediate rollers and/or the take-up roller is driven for pulling the oil-impregnated web from the supply roll onto the take-up roll.

As explained above, if the torque applied to the supply roll is maintained constant, the tension in the oil impregnated web will increase as the diameter of the supply roll decreases due to unwinding of the oil impregnated web. As the tension increases the oil impregnated web can become distorted, thus affecting the uniformity and rate of oil delivery to the heated fuser roller. Non-uniform and variable rate of oil delivery to the heated fuser roller can cause unacceptable image quality defects in the fused marking particle image on the receiver member.

SUMMARY OF THE INVENTION

In view of the foregoing discussion, an object of this invention is to provide a variable torque device so as to maintain constant tension in a web of material, as the web is unwound from a supply roll. The variable torque device of this invention includes a lead screw attached to the shaft of the supply roll via an appropriate gear ratio. A coil spring is located between a hub on the lead screw and a set of rings and friction pads. The spring constant is selected to meet the torque requirement corresponding to the desired web tension. As the lead screw rotates, the hub translates, thus changing the displacement of the coil spring, which in turn changes the loading of the rings and friction pads. With a full supply roll, the coil spring is compressed so as to create an amount of torque to create the desired web tension. As the supply roll unwinds, the rotation of the lead screw translates the hub to expand the coil spring, reducing the torque and maintaining the web tension constant.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
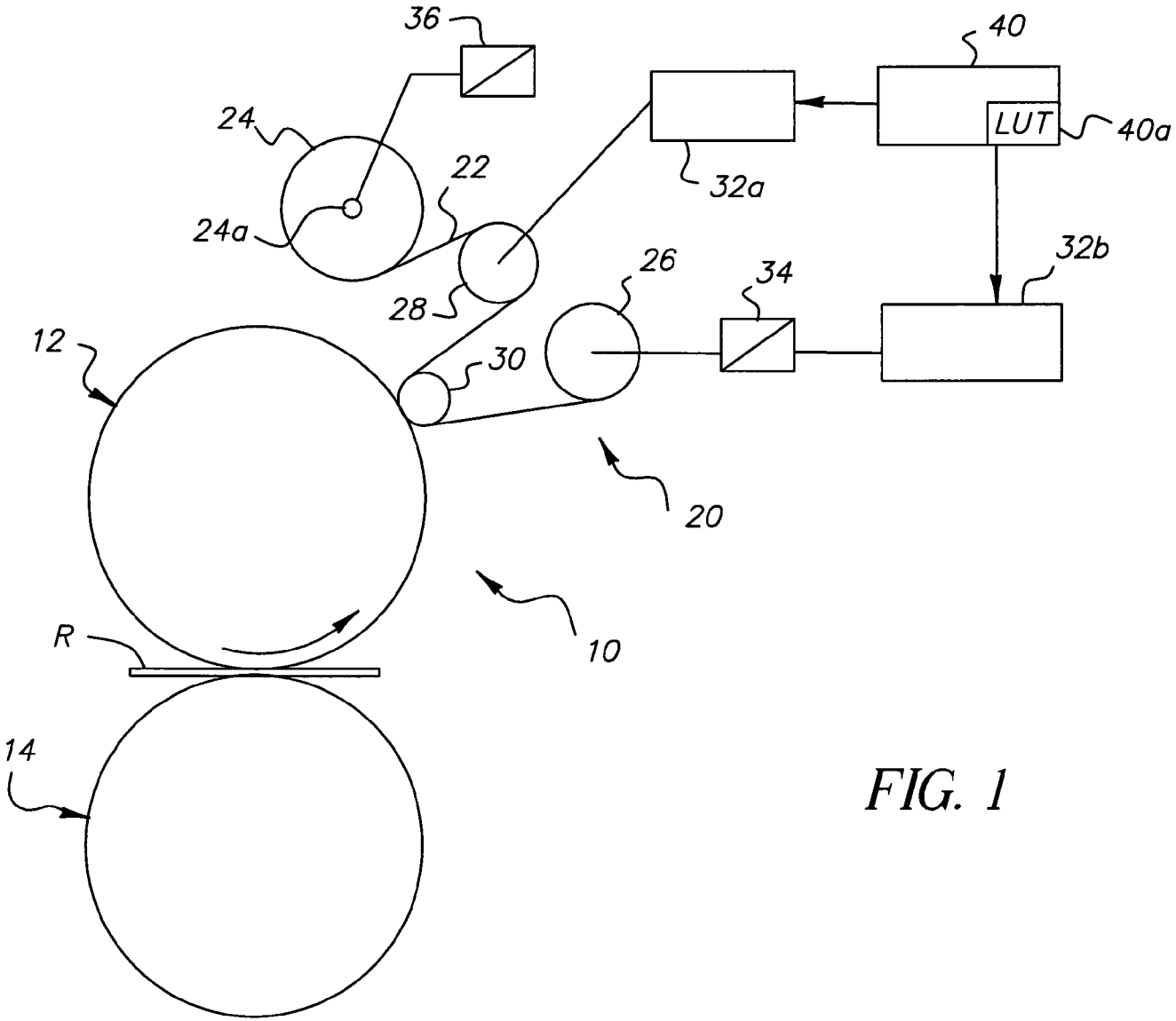
FIG. 1 is a schematic side elevational view of an electrostatographic reproduction apparatus fusing assembly, including an oil impregnated web oiler mechanism, the tension of which may be maintained by this invention.

Referring to FIG. 1, there is schematically shown various components of an electrostatographic reproduction apparatus fuser assembly, including an oil impregnated web oiler mechanism, the tension of which may be maintained by the variable torque device of this invention. The fuser assembly, designated generally by the numeral 10, has a fusing member 12 in the form of a roller, although a belt, sleeve, or any other variation thereof would be applicable. The fusing member 12 is heated, and is located in nip relation with a pressure roller 14. The fusing nip between the rollers 12 and 14 is associated with the receiver member transport path of the reproduction apparatus. That is, as a receiver member R bearing a marking particle image travels along the transport path, the marking particle image is fixed to the receiver member R by application of heat and pressure in the fusing nip before the receiver member R is delivered from the transport path to an output device or a duplex reproduction re-circulation path.

The oil impregnated web oiler mechanism is designated generally by the numeral 20. The oil impregnated web oiler mechanism 20 includes an elongated web 22 extending from a supply roll 24 to a take-up roll 26. The elongated web 22 is, for example, formed as a porous membrane capable of retaining release oil. Illustrative examples of such porous membrane would be micro-porous PTFE web materials, or non-woven polyester web materials. The elongated web 22 is impregnated with any well known release oil, for example silicone oils with functional groups such as amino or mercaptu groups. That portion of the web 22 between the supply roll 24 and take-up roll 26 is directed about intermediate rollers 28 and 30. The intermediate roller 28, is a drive roller, driven by a motor 32*a,* for removing the web from the supply roll 24. The intermediate roller 30 is a back-up roller urging the web into intimate contact with the fusing member 12 to apply impregnated oil from the web to the fusing member surface. The take-up roll 26 is coupled to a drive motor 32*b* through a slip clutch 34 for winding the web on the take-up reel. The supply roll 24 is associated with variable torque device 36 for maintaining constant tension in web 22 as it is fed from the supply roll and wound on the take-up roll. As shown the direction of movement of the web 22 is opposite to the direction of movement of the surface of the fusing member 12.

Motors 32*a,* 32*b* (may be a single motor with plural output drives) are operatively associated with a logic and control unit 40 to receive appropriate activation signals therefrom to turn on the motors for a predetermined period of time. The logic and control unit 40 includes, for example, a microprocessor receiving appropriate input signals. Based on such signals and a suitable program for the microprocessor, the unit 40 produces signals to control operation of the reproduction apparatus and carrying out of the reproduction process. The production of the program for a number of commercially available microprocessors is a conventional skill well understood in the art. The particular details of any such program would, of course, depend upon the architecture of the designated microprocessor.

As noted above, the logic and control unit 40 may be located in the main reproduction apparatus logic and control or in the separate logic and control for the fuser assembly 10. A look-up-table 40*a* is incorporated in the logic and control unit 40. The look-up-table interrelates the drive for the motors 32*a,* 32*b* with the receiver member type and the image content. Accordingly, the movement of the web 22 relative to the fuser member 12 effects a controlled lay down of release oil per receiver member. Therefore, excess oil on the receiver member is substantially avoided, particularly on coated and transparent media, and oil-related image quality defects in the image on the receiver member are prevented. Moreover, less oil is carried out by the fused receiver members, and thus there is potential for less contamination of other reproduction apparatus systems by the release oil during duplex printing runs.

Figure 2:
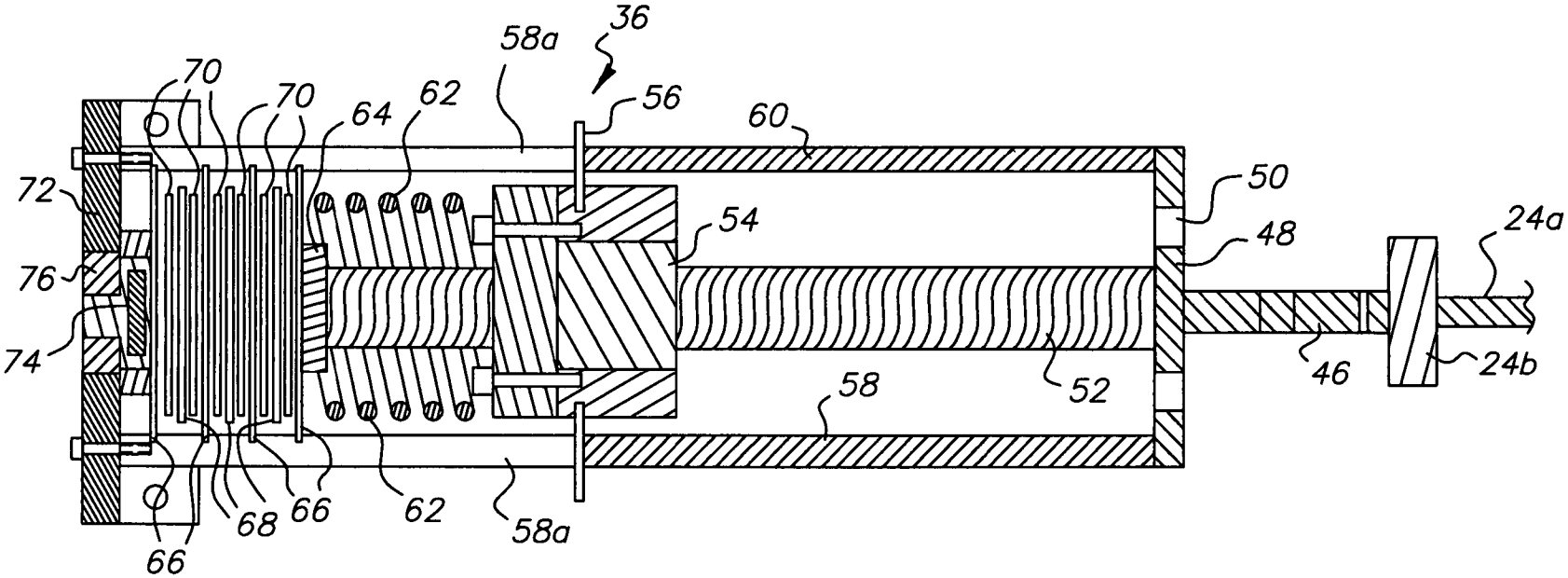
FIG. 2 is a side elevational, cross-section view of the variable torque device according to this invention.
Figure 3A:
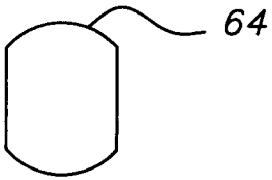
FIG. 3A is a radial section view of one component, hub 64, of the variable torque device of FIG. 1.

As discussed above, if the tension in web 22 increases, as web 22 is unwound from supply roll 24, web 22 may become distorted, resulting in non-uniform and variable rate oil delivery to fusing member 12. In order to maintain the tension in web 22 constant, as it is unwound from supply roll 24, the torque on supply 24, is controlled by the variable torque device 36 of this invention. Referring to FIG. 2, there is shown a cross-section view of variable torque device 36 of this invention. A lead screw 52 is terminated at one end with a hub 64 and at the other end with a connecting shaft 46. The radial cross-section of hub 64 is circular with two flats as shown in FIG. 3A. Lead screw 52 is rotatably mounted axially within a cylindrical housing 58, by bearing 48, in transverse end plate 50, at the connecting shaft end, and by bearing 76, in transverse end plate 72, at the hub end.

Figure 3B:
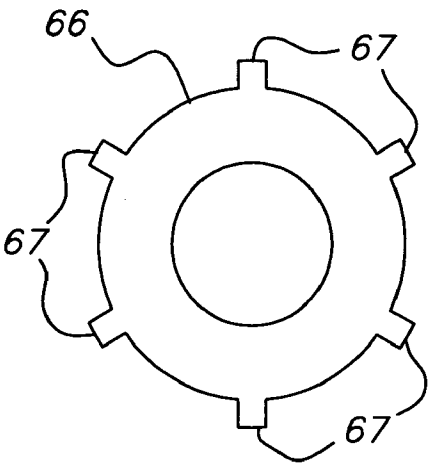
FIG. 3B is a radial view of a second component, non-rotating disk 66, of the variable torque device of FIG. 1.
Figure 3C:
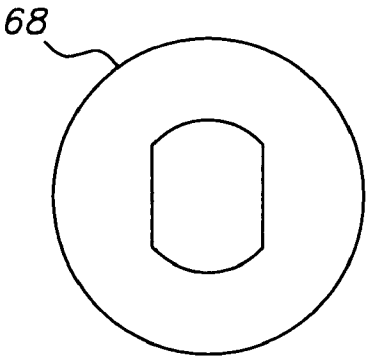
FIG. 3C is a radial view of a third component, rotating disk 68, of the variable torque device of FIG. 1.
Figure 3D:
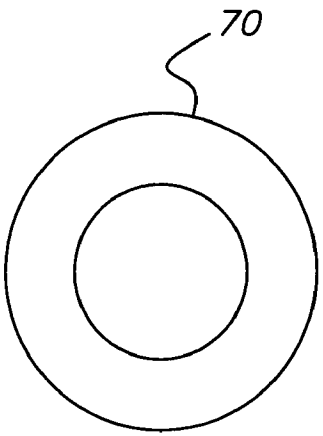
FIG. 3D is a radial view of a fourth component, friction disk 70, of the variable torque device of FIG. 1.
Figure 4:
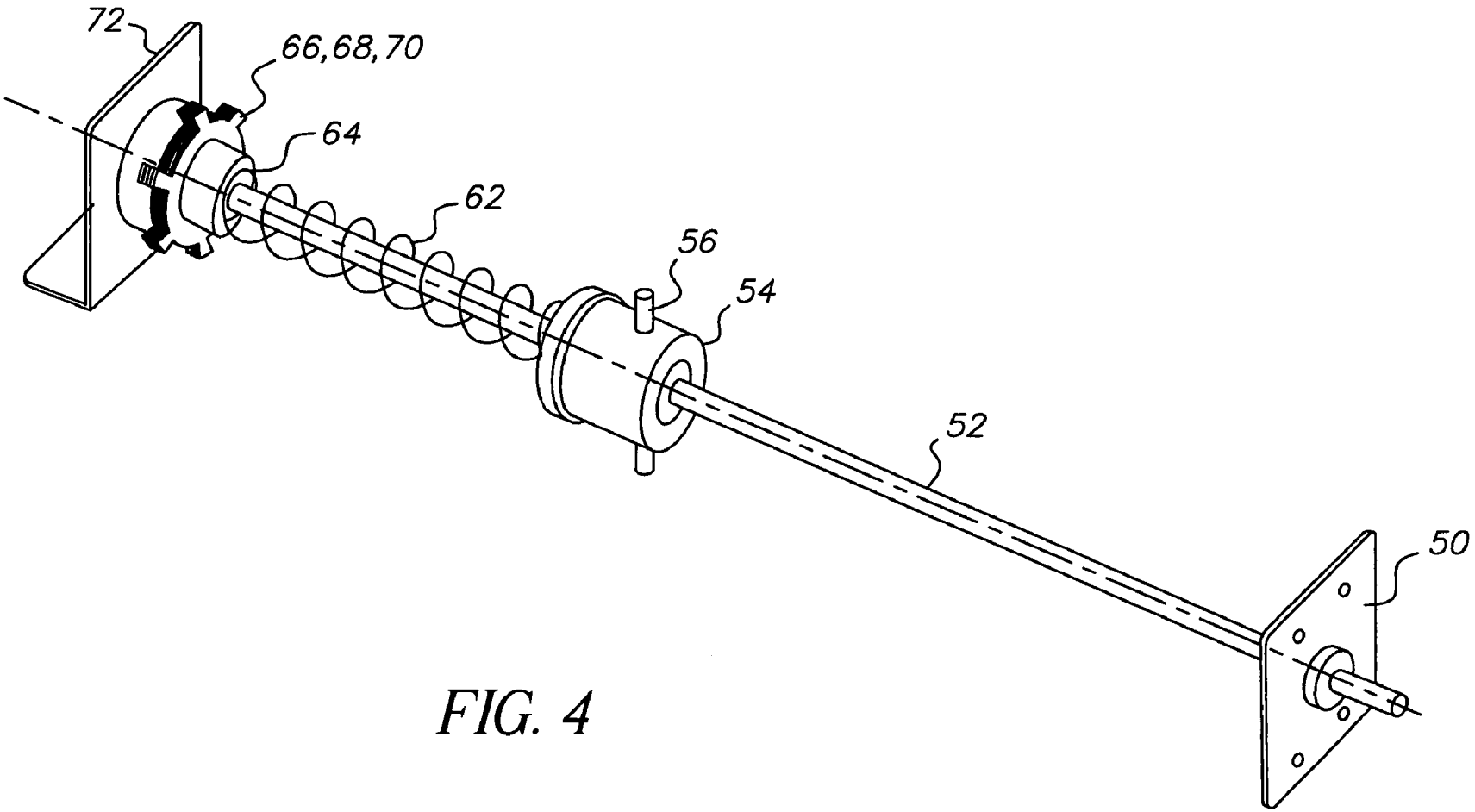
FIG. 4 is a perspective view of the sub-assembly of lead screw, hub, coil spring, and disks of this invention.
Figure 5:
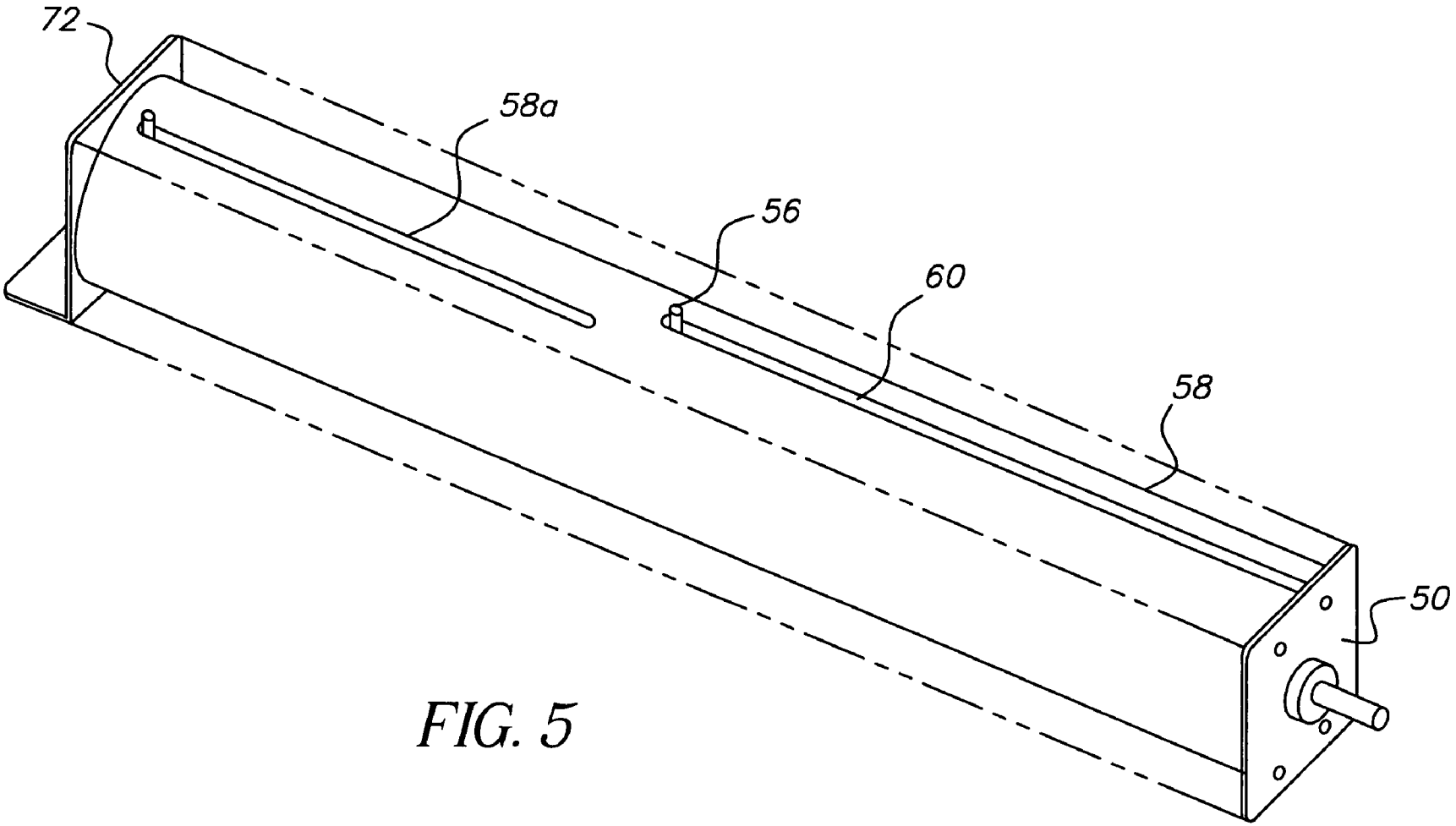
FIG. 5 is a perspective view of the housing containing the sub-assembly of FIG. 4.

Transversely interleaved on hub 64 are rings 66 and 68 and friction pads 70. Rings 66, shown in FIG. 3B, have ears 67 protruding from the outer periphery and a circular inner periphery. Ears 67 extend respectively into a series of axial grooves 58*a* (only two shown in FIG. 2) in the inner wall of cylindrical housing 58. Rings 66 are thus constrained from rotating with hub 64, but are free to move axially. Rings 68, shown in FIG. 3C, have a circular outer periphery and a circular inner periphery with two flats. Rings 68 thus rotate with hub.64 and are also free to move axially. Friction pads 70, shown in FIG. 3D, have circular outer and inner peripheries. Friction pads 70 are thus free to move axially and may or may not rotate depending upon their frictional relationship to rings 66 and 68. In the embodiment shown in FIG. 2 rings and friction pads are positioned on hub 64 in the sequence 66-70-68-70-66-70-68-70-66-70-68-70-66. The number of rings and friction pads on hub 64 may vary, depending upon the torque requirements, but the minimum will be the sequence 66-70-68-70-66. Thus if n rings 66 are used, (n-1) rings 68 and 2(n-1) friction pads 70 will be used. Collar 74 is placed on hub 64, before the first ring 66, to space the first ring 66 from transverse end plate 76.

Threaded hub 54 rides on lead screw 52 and is constrained from rotating by pins 56 protruding from threaded hub 54 into axial grooves 60 in cylindrical housing 58. Thus, as lead screw 52 rotates, threaded hub 54 translates axially. A coil spring 62 is positioned between threaded hub 54 and the last of rings 66 on hub 64. As lead screw 52 rotates and threaded hub 54 translates axially, the displacement of coil spring 62 changes, which changes the compression loading on the rings 66 and 68 and friction pads 70 on hub 64. As the compression loading on the rings 66 and 68 and friction pads 70 on hub 64 changes, the torque exerted on lead screw 52 changes.

The variable torque device of this invention, described above, maintains the tension in web 22 constant as web 22 is unwound from supply roll 24 as follows: Connecting shaft 46 is connected to the shaft 24*a* of supply roll 24 through a gear reduction coupling 24*b*, of any well known design. The combination of the pitch of lead screw 52 and the reduction ratio of the coupling between the shaft 24*a* of supply roll 24 and connecting shaft 46 is selected so that threaded hub 54 travels a predetermined distance in the number of revolutions that are required to completely unwind a new supply roll 24. When a new supply roll 24 is installed, threaded hub 54 is positioned for maximum compression of coil spring 62. The combination of the spring constant of coil spring 62 and the number and frictional characteristics of rings 66, 68, and friction pads 70 are selected so that the torque on lead screw 52, at the maximum compression of lead screw 52, is less than will result in enough tension in web 22 to cause distortion in web 22. As web 22 is unwound from supply roll 24, the rotation of lead screw 52 translates threaded hub in the direction to expand coil spring 62 (to the right in FIG. 2), thus reducing the compression loading on rings 66, 68, and friction pads 70, thereby reducing the torque on lead screw 52. The reduction of the torque on lead screw 52 is such as to maintain the tension in web 22 as the diameter of supply roll 24 decreases as web 22 is unwound from supply roll 24.

Rings 66 and 68 and friction pads 70, are of the type typically used in slip clutches, such as those manufactured by Custom Products Corporation. Rings 66 and 68 are typically metal, for example, brass, or steel. The material of friction pads 70 is typically non-metallic and chosen for its frictional properties with respect to rings 66 and 68. In the embodiment described above, friction pads 70 are separate from rings 66 and 68. However, an alternative is to bond friction pads 70 to one of rings 66 or 68. For example a friction pad 70 may be bonded to each side of each ring 68 or alternatively, to each side of each ring 66.

The invention has been described in detail with particular reference to preferred embodiments thereof, but it should be understood that variations and modifications can be effected within the spirit and scope of the invention.

What is claimed is:

1. A variable torque device comprising:

a housing terminated at one end with a first transverse plate and at the opposite end with a second transverse plate;

a threaded axial shaft terminated at one end with a hub and at the opposite end with a non-threaded section, said hub rotatably connected to said first transverse plate and said non-threaded section rotatably connected to said second transverse plate;

a plurality of friction members, positioned transversely on said hub in sliding contact with one another, cooperating within said housing so as to be free to move in an axial direction;

a threaded hub member on said threaded axial shaft and cooperating with said housing so as to be constrained from rotating, but free to move in an axial direction in response to rotation of said threaded shaft; and a force-generating urging member positioned axially between said threaded hub member and said plurality of friction members such that the amount of force generated by said urging member varies as said threaded hub member moves axially in response to rotation of said threaded axial shaft, thereby varying the torque applied to said threaded axial shaft due to the varying frictional force between individual members of said plurality of friction members.

2. The variable torque device described in claim 1 wherein said plurality of friction members includes at least two first members positioned transversely on said hub, cooperating with said housing and said hub so as to be constrained from rotating, but free to move in an axial direction, at least one second member operatively connected transversely to said hub so as to rotate with said hub, but free to move in an axial direction, and positioned between two of said first members, and at least two third members positioned transversely on said hub between and in sliding contact with each of said first and said second members.

3. The variable torque device described in claim 2 wherein, if the number of first members is n, then the number of second members is (n-1) and the number of third members is 2(n-1).

4. The variable torque device described in claim 2 wherein said force-generating urging member is coil spring.

5. The variable torque device described in claim 4 wherein each of said first members and said second members is metallic and each of said third members is non-metallic.

6. The variable torque device described in claim 2 wherein said threaded hub has at least one radial protrusion and said cylindrical housing has at least one axial slot into which said at least one radial protrusion protrudes, thereby preventing said threaded hub from rotating in response to rotation of said threaded axial shaft.

7. The variable torque device described in claim 6 wherein each of said third members is bonded to each side of each of said first members.

8. The variable torque device described in claim 6 wherein each of said third members is bonded to each side of each of said second members.

9. A variable torque device for maintaining constant tension in a web being unwound from a supply roll mounted on a shaft, comprising:

a housing terminated at one end with a first transverse plate and at the opposite end with a second transverse plate;

a threaded axial shaft terminated at one end with a hub and at the opposite end with a non-threaded section connected to said shaft of said supply roll, said hub rotatably connected to said first transverse plate and said non-threaded section rotatably connected to said second transverse plate;

a plurality of friction members, positioned transversely on said hub in sliding contact with one another, cooperating within said housing so as to be free to move in an axial direction;

a threaded hub member on said threaded axial shaft and cooperating with said housing so as to be constrained from rotating, but free to move in an axial direction in response to rotation of said threaded shaft; and a force-generating urging member positioned axially between said threaded hub member and said plurality of friction members such that the amount of force generated by said urging member varies as said threaded hub member moves axially in response to rotation of said threaded axial shaft, thereby varying the torque applied to said threaded axial shaft and said supply roll shaft due to the varying frictional force between individual members of said plurality of friction members.

10. The variable torque device described in claim 9 wherein said plurality of friction members includes at least two first members positioned transversely on said hub, cooperating with said housing and said hub so as to be constrained from rotating, but free to move in an axial direction, at least one second member operatively connected transversely to said hub so as to rotate with said hub, but free to move in an axial direction, and positioned between two of said first members, and at least two third members positioned transversely on said hub between and in sliding contact with each of said first and said second members.

11. The variable torque device described in claim 10 wherein, if the number of first members is n, then the number of second members is (n-1) and the number of third members is 2(n-1).

12. The variable torque device described in claim 10 wherein said force-generating urging member is coil spring.

13. The variable torque device described in claim 12 wherein each of said first members and said second members is metallic and each of said third members is non-metallic.

14. The variable torque device described in claim 10 wherein said threaded hub has at least one radial protrusion and said cylindrical housing has at least one axial slot into which said at least one radial protrusion protrudes, thereby preventing said threaded hub from rotating in response to rotation of said threaded axial shaft.

15. The variable torque device described in claim 14 wherein each of said third members is bonded to each side of each of said first members.

16. The variable torque device described in claim 14 wherein each of said third members is bonded to each side of each of said second members.

17. A variable torque device for maintaining constant tension in a release oil impregnated web oiler of a fuser for an electrostatographic reproduction apparatus, said release oil impregnated web being unwound from a supply roll mounted on a shaft, said variable torque device comprising:

a housing terminated at one end with a first transverse plate and at the opposite end with a second transverse plate;

a threaded axial shaft terminated at one end with a hub and at the opposite end with a non-threaded section connected to said shaft of said supply roll, said hub rotatably connected to said first transverse plate and said non-threaded section rotatably connected to said second transverse plate;

a plurality of friction members, positioned transversely on said hub in sliding contact with one another, cooperating within said housing so as to be free to move in an axial direction;

a threaded hub member on said threaded axial shaft and cooperating with said housing so as to be constrained from rotating, but free to move in an axial direction in response to rotation of said threaded shaft; and a force-generating urging member positioned axially between said threaded hub member and said plurality of friction members such that the amount of force generated by said urging member varies as said threaded hub member moves axially in response to rotation of said threaded axial shaft, thereby varying the torque applied to said threaded axial shaft and said supply roll shaft due to the varying frictional force between individual members of said plurality of friction members.

18. The variable torque device described in claim 17 wherein said plurality of friction members includes at least two first members positioned transversely on said hub, cooperating with said housing and said hub so as to be constrained from rotating, but free to move in an axial direction, at least one second member operatively connected transversely to said hub so as to rotate with said hub, but free to move in an axial direction, and positioned between two of said first members, and at least two third members positioned transversely on said hub between and in sliding contact with each of said first and said second members.

19. The variable torque device described in claim 18 wherein, if the number of first members is n, then the number of second members is (n-1) and the number of third members is 2(n-1).

20. The variable torque device described in claim 18 wherein said force-generating urging member is coil spring.

21. The variable torque device described in claim 20 wherein each of said first members and said second members is metallic and each of said third members is non-metallic.

22. The variable torque device described in claim 18 wherein said threaded hub has at least one radial protrusion and said cylindrical housing has at least one axial slot into which said at least one radial protrusion protrudes, thereby preventing said threaded hub from rotating in response to rotation of said threaded axial shaft.

23. The variable torque device described in claim 22 wherein each of said third members is bonded to each side of each of said first members.

24. The variable torque device described in claim 22 wherein each of said third members is bonded to each side of each of said second members.

* * * * *